US007764025B2

(12) United States Patent
Kobayashi

(10) Patent No.: US 7,764,025 B2
(45) Date of Patent: Jul. 27, 2010

(54) POWER SUPPLY APPARATUS AND HIGH-FREQUENCY CIRCUIT SYSTEM

(75) Inventor: Junichi Kobayashi, Kanagawa (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 607 days.

(21) Appl. No.: 11/754,880

(22) Filed: May 29, 2007

(65) Prior Publication Data

US 2007/0279009 A1 Dec. 6, 2007

(30) Foreign Application Priority Data

May 31, 2006 (JP) ..... 2006-151983

(51) Int. Cl.
*H05B 37/02* (2006.01)
*H05B 39/04* (2006.01)

(52) U.S. Cl. ..... 315/299; 315/307

(58) Field of Classification Search ..... 315/200 R, 315/209 R, 224, 227 R, 291, 299, 307, 311, 315/3.5

See application file for complete search history.

(56) References Cited

U.S. PATENT DOCUMENTS 4,400,660 A 8/1983 Schaefer 5,982,158 A 11/1999 Schnars et al.

FOREIGN PATENT DOCUMENTS

JP 2005-045478 A 2/2005
WO WO 93/11606 A1 6/1993

OTHER PUBLICATIONS

Tsuneoka M et al: "Design and testing of power supplies for the high power gyrotron" Proceedings of the IEEE/NPSS Symposium on Fusion Engineering. San Diego, Sep. 30-Oct. 3, 1991, New York, IEEE, US vol. vol. 2 Symp 14, Sep. 30, 1991, pp. 497-500, XP010049337 ISBN: 0-7803-0132-3.

*Primary Examiner*—Douglas W Owens
*Assistant Examiner*—Minh D A
(74) *Attorney, Agent, or Firm*—Sughrue Mion, PLLC

(57) ABSTRACT

A power supply apparatus has a series regulator for generating a predetermined power supply voltage from a DC voltage output from the rectifying circuit, and a capacitor bank of rectifying capacitors for stabilizing the power supply voltage. The power supply apparatus also has a charging bypass circuit connected between input and output terminals of the series regulator. The charging bypass circuit is turned on or off by an externally supplied drive signal, When a drop of the power supply voltage is detected, the charging bypass circuit is turned on.

9 Claims, 4 Drawing Sheets

POWER SUPPLY APPARATUS AND HIGH-FREQUENCY CIRCUIT SYSTEM

This application is based upon and claims the benefit of priority from Japanese Patent Application No. 2006-151983 filed on May 31, 2006, the disclosure of which is incorporated herein in its entirety by reference.

BACKGROUND OF THE INVENTION

1. Field of the Invention

The present invention relates to a power supply apparatus for supplying a predetermined DC voltage to an electronic tube that is used to amplify and oscillate a high-frequency signal, and a high-frequency circuit system which incorporates such a power supply apparatus.

2. Description of the Related Art

Travelling-wave tubes and klystrons are electron tubes for amplifying and oscillating a high-frequency signal based on an interaction between an electron beam emitted from an electron gun and a high-frequency circuit. As shown in FIG. 1 of the accompanying drawings, traveling-wave tube 1 has electron gun 10 for emitting electron beam 50, helix 20 serving as a high-frequency circuit for causing electron beam 50 emitted from electron gun 10 and a high-frequency signal (microwave) to interact with each other, collector electrode 30 for trapping electron beam 50 output from helix 20, and anode electrode 40 for drawing electrons from electron gun 10 and guiding electron beam 50 emitted from electron gun 10 into helix 20.

Electron gun 10 has cathode electrode 11 for emitting negative thermions, heater 12 for applying thermal energy to cathode electrode 11 to emit negative thermions therefrom, and Wehnelt cathode 13 for focusing emitted electrons into electron beam 50.

Electron beam 50 emitted from electron gun 10 is accelerated by the potential difference between cathode electrode 11 and helix 20 and introduced into helix 20. Electron beam 50 travels in helix 20 while interacting with the high-frequency signal input to helix 20. Electron beam 50 that is output from helix 20 is trapped by collector electrode 30. At this time, helix 20 outputs a high-frequency signal that has been amplified by an interaction with electron beam 50.

As shown in FIG. 1, the electrons of traveling-wave tube 1 are supplied with predetermined power supply voltages from power supply apparatus 70. Power supply apparatus 70 has helix power supply 71 for supplying a DC voltage (helix voltage Ehel), which is negative with respect to the potential of helix 20, to cathode electrode 11, collector power supply 72 for supplying a DC voltage (collector voltage Ecol), which is positive with respect to the potential of cathode electrode 11, to collector electrode 30, anode electrode 73 for supplying a DC voltage (anode voltage Ea), which is positive with respect to the potential of cathode electrode 11, to anode electrode 40, and heater power supply 74 for supplying a heater voltage Eheat, which is an AC voltage or a DC voltage with respect to the potential of cathode electrode 11, to heater 12 of electron gun 10. Helix 20 is normally connected to the case of traveling-wave tube 1 and grounded.

As shown in FIG. 2 of the accompanying drawings, helix power supply 71 comprises rectifying circuit 102 for rectifying an AC voltage output from the secondary winding of transformer 101, series regulator 103 for generating the helix voltage Ehel from an output voltage (DC voltage) of rectifying circuit 102, and capacitor bank 104 having rectifying capacitors for stabilizing the helix voltage Ehel. The primary winding of transformer 101 is connected to a known inverter, not shown, and supplied with an AC voltage therefrom.

Traveling-wave tube 1 shown in FIG. 1 is capable of controlling the amount of electrons emitted from cathode electrode 11 with the anode voltage Ea applied to anode electrode 40. Therefore, the electric power of the high-frequency signal output from traveling-wave tube 1 can be controlled by anode voltage Ea. For example, even while a high-frequency signal of constant electric power is being input to traveling-wave tube 1, traveling-wave tube 1 can output a pulsed high-frequency signal by applying a pulsed voltage to anode electrode 40.

An arrangement for controlling the high-frequency signal output from traveling-wave tube 1 with anode voltage Ea is disclosed in Japanese Patent Laid-Open No. 2005-45478, for example. Japanese Patent Laid-Open No. 2005-45478 reveals a circuit whose electric power efficiency is increased by detecting an input signal (high-frequency signal) applied to traveling-wave tube 1 and controlling the anode voltage Ea so that the output electric power will not be saturated, depending on the input electric power.

The helix voltage applied to traveling-wave tube 1 is normally a high DC voltage ranging from several hundreds V to several kV. Therefore, as shown in FIG. 2, conventional power supply apparatus 70 employs a plurality of series-connected transistors in series regulator 103 for reducing the voltage applied to each of the transistors.

Series regulator 103 shown in FIG. 2 is supplied with an input DC voltage which is output from rectifying circuit 102 and which is higher than the helix voltage Ehel. The collector-to-emitter voltage of each of the transistors of series regulator 3 is regulated to stabilize the output voltage of the power supply apparatus, i.e., the power supply voltage (helix voltage Ehel).

However, series regulator 103 shown in FIG. 2 has a relatively large output impedance value because the power supply voltage (helix voltage Ehel) is output through the series-connected transistors. Furthermore, as the time constant is large while series regulator 103 is in operation, series regulator 103 is unable to act upon load variations in times ranging from several μsec. to several msec.

Specifically, the power supply apparatus has series regulator 103 for supplying a power supply voltage through the series-connected transistors. When the power supply apparatus applies a pulsed voltage to anode electrode 40, for example, to bring traveling-wave tube 1 into pulsed operation, capacitor bank 104 discharges an abrupt energy depending on a load variation due to the pulsed operation. The voltage control operation of series regulator 103 is unable to follow the abrupt energy discharged from capacitor bank 104, resulting in a large drop of the power supply voltage (helix voltage Ehel) as the output voltage.

In order to avoid the above problem, the conventional power supply apparatus has reduced the drop of the power supply voltage by employing a large capacitance value for capacitor bank 104. As a result, the conventional power supply apparatus has suffered another problem, i.e., a large circuit scale.

Since the helix voltage Ehel is a DC voltage which is negative with respect to the potential of helix 20, as described above, the drop of the helix voltage Ehel means that the helix voltage Ehel approaches the ground potential (0 V). A load refers to the resistive component of each of the various electrodes of the traveling-wave tube that is connected to the output terminals of the power supply apparatus. For example, the load of helix power supply 71 refers to a resistive component between cathode electrode 11 and helix 20.

SUMMARY OF THE INVENTION

It is an object of the present invention to provide a power supply apparatus which is capable of reducing variation in the power supply voltage even when a load varies greatly, e.g., even if a pulsed voltage is applied to an anode electrode, for example, to drive an electron tube in a pulsed mode, and a high-frequency circuit system which incorporates such a power supply apparatus.

To achieve the above object, a power supply apparatus according to the present invention includes a rectifying circuit, a series regulator for generating a predetermined power supply voltage from a DC voltage output from the rectifying circuit, a capacitor bank of rectifying capacitors for stabilizing the power supply voltage, a charging bypass circuit connected between input and output terminals of the series regulator, the charging bypass circuit that is to be turned on or off by an externally supplied drive signal, and a charging bypass control circuit for turning on the charging bypass circuit when a drop in the power supply voltage is detected.

A high-frequency circuit system according to the present invention includes the above power supply apparatus, an electron tube that is to be supplied with the predetermined power supply voltage from the power supply apparatus, an anode switch for supplying a pulsed voltage to an anode electrode of the electron tube, and an anode switch control circuit for driving the anode switch and supplying the charging bypass control circuit with an anode pulse input signal indicative of whether the electron tube is activated or inactivated. The charging bypass control circuit turns on the charging bypass circuit if the charging bypass control circuit detects when the pulsed voltage has been applied to the anode electrode based on the anode pulse input signal.

In the power supply apparatus and the high-frequency circuit system described above, when the power supply voltage drops, the charging bypass circuit is turned on by the charging bypass control circuit, and electric charges are supplied from the rectifying circuit through the charging bypass circuit to the capacitor bank, quickly charging the capacitor bank. Consequently, variation in the power supply due to a load variation can be reduced without the need for increasing the capacitance of the capacitor bank.

Therefore, the high-frequency circuit system is capable of reducing a variation in the power supply voltage even when a pulsed voltage is applied to the anode electrode to drive the electron tube in a pulsed mode.

The above and other objects, features, and advantages of the present invention will become apparent from the following description with reference to the accompanying drawing which illustrate example of the present invention.

DETAILED DESCRIPTION OF THE PREFERRED EMBODIMENT

Figure 3:
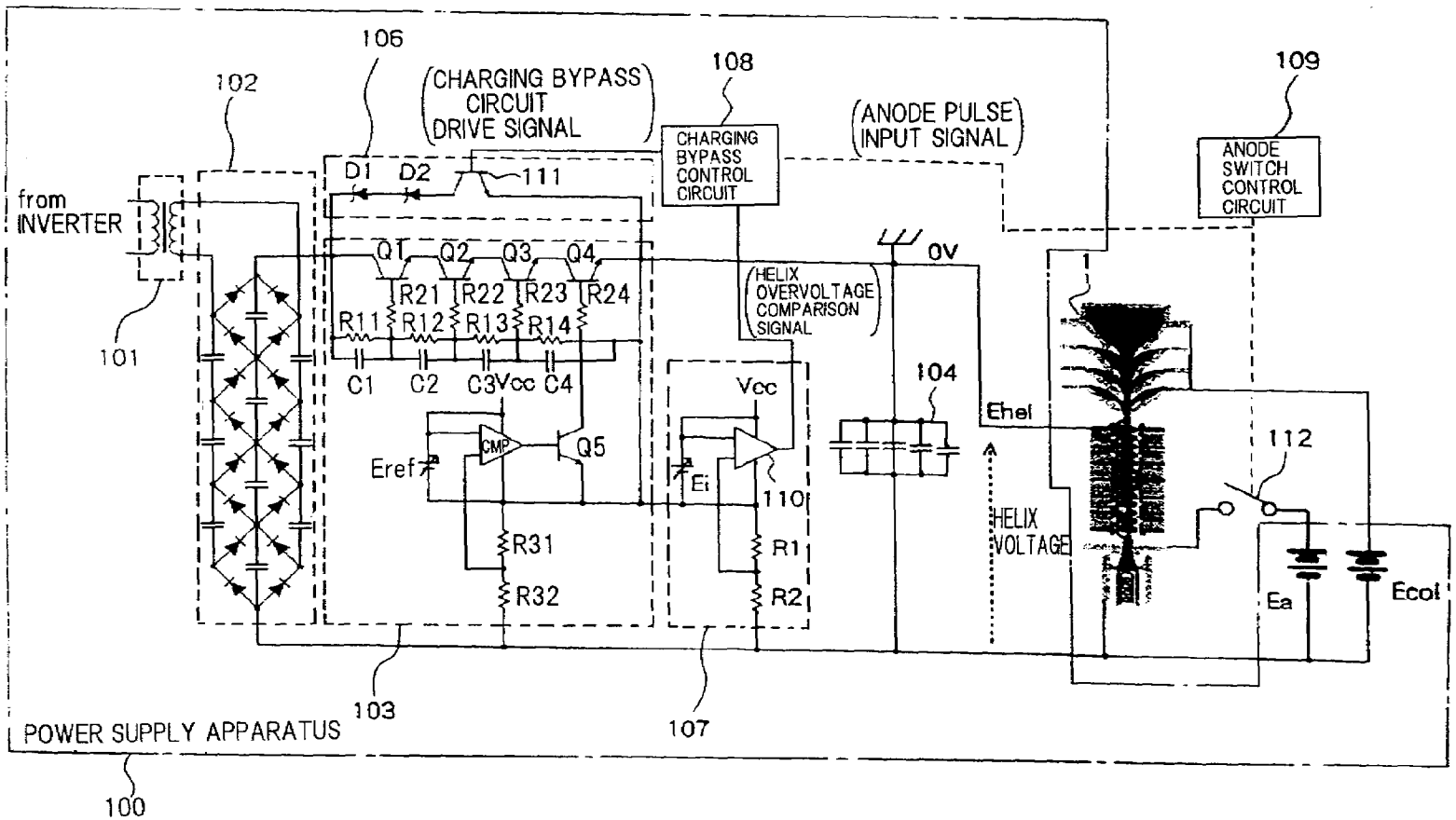
FIG. 3 is a circuit diagram showing an arrangement of a power supply apparatus according to the present invention and a high-frequency circuit system including the power supply apparatus according to the present invention.

As shown in FIG. 3, a high-frequency circuit system according to the present invention has traveling-wave tube 1, anode switch 112, anode switch control circuit 109, and power supply apparatus 100.

Traveling-wave tube 1 has a structure identical to the traveling-wave tube shown in FIG. 1 and will not be described in detail below. Anode switch 112 is connected to the anode electrode of traveling-wave tube 1 and turns on and off the anode voltage Ea generated by power supply apparatus 100 to apply a pulsed voltage to the anode electrode. Anode switch control circuit 109 is a circuit for controlling the turning-on/-off operation of anode switch 112. In addition to supplying a drive signal to anode switch 112, anode switch control circuit 109 supplies a charging bypass control circuit, to be described later, of power supply apparatus 100 with an anode pulse input signal indicative of whether traveling-wave tube 1 is activated or inactivated. The anode pulse input signal is the same as the drive signal supplied to anode switch 112.

As shown in FIG. 3, power supply apparatus 100 according to the present invention comprises transformer 101, rectifying circuit 102 for rectifying an AC voltage output from the secondary winding of transformer 101, series regulator 103 for generating a helix voltage Ehel as a power supply voltage from an output voltage (DC voltage) of rectifying circuit 102, capacitor bank 104 having rectifying capacitors for stabilizing the power supply voltage output from series regulator 103, charging bypass circuit 106 which is turned on or off by an externally supplied drive signal, overvoltage comparing circuit 107 for detecting whether the power supply voltage (helix voltage Ehel) output from power supply apparatus 100 has exceeded a predetermined voltage value or not, and charging bypass control circuit 108 for turning on charging bypass circuit 106 if a drop of the helix voltage Ehel has been detected and for turning off charging bypass circuit 106 if overvoltage comparing circuit 107 detects when helix voltage Ehel has exceeded the predetermined voltage value. The primary winding of transformer 101 is connected to a known inverter, not shown, and supplied with an AC voltage therefrom, as with the conventional power supply apparatus.

Rectifying circuit 102 comprises a plurality of full-wave rectifying circuits, each made up of four bridge-connected diodes, connected in series with each other through capacitors. In FIG. 3, rectifying circuit 102 comprises four full-wave rectifying circuits connected in series with each other through capacitors. Rectifying circuit 102 shown in FIG. 3 rectifies an AC voltage output from the secondary winding of transformer 101 by way of full-wave rectification, and outputs an increased voltage which is a combination of DC voltages output from the respective full-wave rectifying circuits.

As shown in FIG. 3, series regulator 103 comprises a plurality of transistors Q1 through Q4 connected in series with each other between input and output terminals thereof and comparator CMP for controlling the output voltage of series regulator 103 at a constant level. The voltage between the input and output terminals of series regulator 103 is divided by four series-connected resistors R11 through R14, and the divided voltages are applied to the respective bases of transistors Q1 through Q3 through respective resistors R21 through R23. Capacitors C1 through C4 are connected parallel to resistors R11 through R14, respectively.

Transistor Q5 has a collector connected to the base of transistor Q4 through resistor R24. The base of transistor Q5 is supplied with an output signal from comparator CMP. The output voltage of series regulator 103 is applied to the emitter of transistor Q5.

The output voltage of series regulator 103 is divided by resistors R31, R32. The divided voltage is compared with a predetermined constant reference voltage Eref by comparator CMP, which turns on or off transistor Q5 depending on the comparison result. According to the illustrated arrangement of series regulator 103, the current supplied to the base of transistor Q4 is controlled to equalize the divided voltage that is output from the junction between resistors R31, R32 to reference voltage Eref. In other words, the current supplied to the base of transistor Q4 is controlled such that series regulator 103 will output a desired constant voltage.

In power supply apparatus 100 shown in FIG. 3, the output terminal of the bank of transistors Q1 through Q4 of series regulator 103 is connected to the helix of traveling-wave tube 1 and set to the ground potential (0 V). Therefore, series regulator 103 shown in FIG. 3 controls the DC voltage (helix voltage Ehel) that is negative with respect to the potential of the helix and which is supplied to the cathode electrode of traveling-wave tube 1.

As shown in FIG. 3, charging bypass circuit 106 has two zener diodes D1, D2 and bypass transistor 111 which are inserted between the input and output terminals of series regulator 103. In FIG. 3, two zener diodes D1, D2 and bypass transistor 111 are connected in series with each other. However, the number of zener diodes D1, D2 is not limited insofar as they can reduce the collector-to-emitter voltage of bypass transistor 111 to a rated voltage or lower.

When charging bypass circuit 106 is turned on, electric charges are supplied from rectifying circuit 102 to capacitor bank 104, not through transistors Q1 through Q4 of series regulator 103, but through charging bypass circuit 106 connected parallel to transistors Q1 through Q4, thereby charging capacitor bank 104. At this time, since electric charges are supplied to capacitor bank 104 through single bypass transistor 111, capacitor bank 104 is charged more quickly than would a conventional power supply apparatus which would charge capacitor bank 104 through transistors Q1 through Q4. Therefore, the time required for helix voltage Ehel, that has dropped due to a load variation, to become stabilized at the original voltage is shortened.

As shown in FIG. 3, overvoltage comparing circuit 107 comprises two resistors R1, R2 for dividing the output voltage of power supply apparatus 100, a constant voltage source for generating a constant DC voltage Ei, and comparator 110 for comparing the voltage divided by resistors R1, R2 with DC voltage Ei and outputting a helix overvoltage comparison signal (e.g., at a high level) when the divided voltage exceeds the DC voltage Ei. Overvoltage comparing circuit 107 is not limited to the circuit arrangement shown in FIG. 3 and may be of any circuit arrangement insofar as it can detect when the output voltage of power supply apparatus 100 exceeds a predetermined voltage value.

Charging bypass control circuit 108 applies a charging bypass circuit drive signal to turn on charging bypass circuit 106 when the load abruptly varies due to pulsed operation of traveling-wave tube 1 and the helix voltage Ehel drops. Charging bypass control circuit 108 turns off charging bypass circuit 106 when the power supply voltage (helix voltage Ehel) output from power supply apparatus 100 exceeds the predetermined voltage value as detected by overvoltage comparing circuit 107.

Charging bypass control circuit 108 may be implemented as a logic circuit comprising a combination of various logic gates or a driver circuit for driving bypass transistor 111 of charging bypass circuit 106.

In the present embodiment, charging bypass control circuit 108 detects a drop of the helix voltage Ehel using a pulsed signal (anode pulse input signal), which is the same as the drive signal for anode switch 112, output from anode switch control circuit 109, and controls charging bypass circuit 106. However, charging bypass control circuit 108 is not limited to the circuit arrangement for controlling charging bypass circuit 106 using the anode pulse input signal, but may control charging bypass circuit 106 using a detected value of the helix voltage Ehel that is supplied to traveling-wave tube 1. If charging bypass control circuit 108 controls charging bypass circuit 106 using a detected value of the helix voltage Ehel, then power supply apparatus 100 may have a voltage detecting circuit for detecting the helix voltage Ehel, and may turn on charging bypass circuit 106 if the voltage detecting circuit detects a drop of the helix voltage Ehel and turn off charging bypass circuit 106 if overvoltage comparing circuit 107 detects when the helix voltage Ehel exceeds the predetermined voltage value.

Operation of power supply apparatus 100 shown in FIG. 3 will be described below with reference to FIG. 4.

Specifically, operation of power supply apparatus 100, at the time that traveling-wave tube 1 shown in FIG. 3 is in pulsed operation, will be described below.

When anode switch control circuit 109 shown in FIG. 3 outputs the drive signal to turn on anode switch 112, the anode electrode of traveling-wave tube 1 is supplied with the anode voltage Ea, and an electron beam passes through the helix and a helix current flows. At this time, the power supply voltage (helix voltage Ehel) output from power supply apparatus 100 drops due to a variation of the load.

Figure 4:
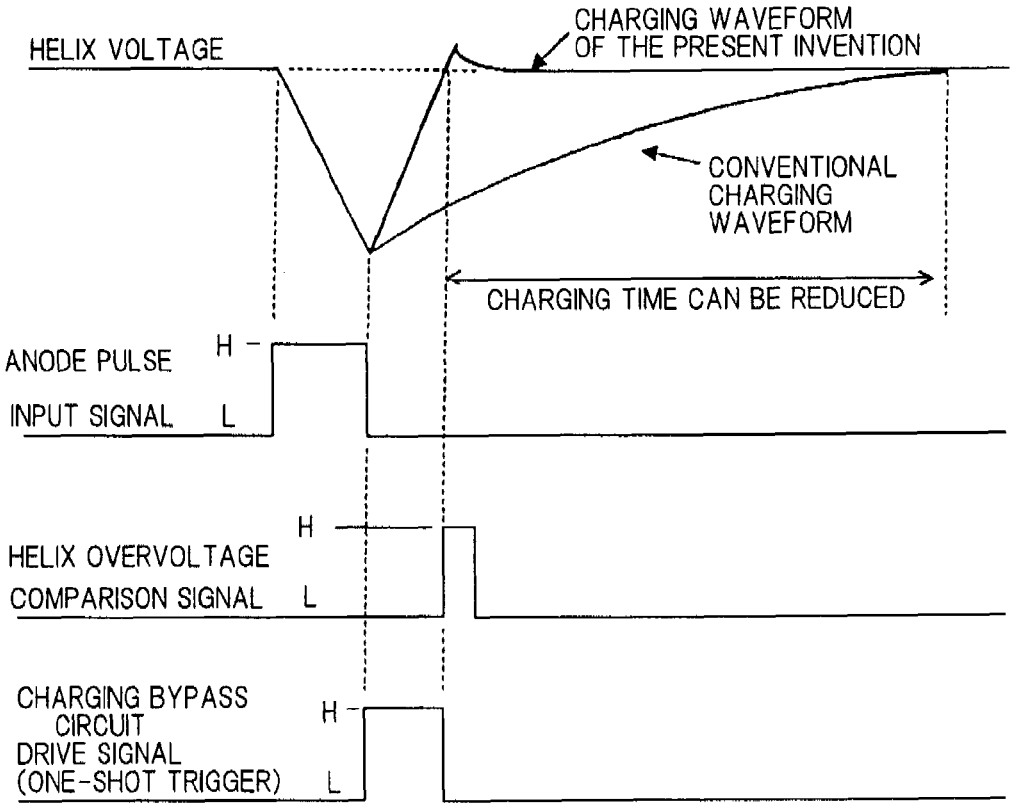
FIG. 4 is a timing chart showing voltage waveforms in various parts of the power supply apparatus shown in FIG. 3.

As shown in FIG. 4, anode switch circuit 109 outputs the anode pulse input signal at a high level, which is the same as the drive signal for anode switch 112, indicating that traveling-wave tube 1 is activated, to charging bypass control circuit 108.

When the output signal from anode switch circuit 109 changes and anode switch 112 is turned off, the anode voltage Ea stops being supplied to the anode electrode of traveling-wave tube 1, and the helix current also stops flowing.

As shown in FIG. 4, the anode pulse input signal output from anode switch control circuit 109 changes to a low level, indicating that traveling-wave tube 1 is inactivated.

Charging bypass control circuit 108 outputs the charging bypass circuit drive signal to turn on charging bypass circuit 106 in synchronism with the switching of the anode pulse input signal from the high level to the low level. Charging bypass circuit 106 turns on bypass transistor 111 to render it conductive based on the charging bypass circuit drive signal. When bypass transistor 111 is turned on, the input terminal (connected to rectifying circuit 102) of series regulator 103 supplies electric charges through charging bypass circuit 106 to capacitor bank 104, charging capacitor bank 104 to increase the helix voltage Ehel. At this time, since the electric charges are supplied, not through transistors Q1 through Q4 of series regulator 103, but through single bypass transistor 111, capacitor bank 104 is charged more quickly than with the conventional power supply apparatus, as shown in FIG. 4.

When the helix voltage Ehel increases beyond the predetermined voltage value, overvoltage comparing circuit 107 outputs the helix overvoltage comparison signal to charging bypass control signal 108.

When charging bypass control signal 108 receives the helix overvoltage comparison signal, charging bypass control signal 108 changes the charging bypass circuit drive signal to the low level to turn off charging bypass circuit 106. Bypass transistor 111 is turned off by the charging bypass circuit drive signal, and hence charging bypass circuit 106 is rendered nonconductive, thus stopping charging capacitor bank 104. As a result, the power supply voltage (helix voltage Ehel) output from power supply apparatus 100 stops increasing and becomes stable.

In the above description, charging bypass circuit 106 is turned on in synchronism with the anode pulse input signal changing from the high level to the low level, and charging bypass circuit 106 is turned off in synchronism with the helix overvoltage comparison signal being output. However, the charging bypass circuit drive signal generated in synchronism with the anode pulse input signal that changes from the high level to the low level may be a pulse (one-shot trigger) signal having a preset time duration. Even if such a one-shot trigger signal is employed as the charging bypass circuit drive signal, it should preferably be combined with the control process for turning off charging bypass circuit 106 when the helix voltage Ehel exceeds the predetermined voltage value.

According to the present invention, when the power supply voltage drops, capacitor 104 is quickly charged through charging bypass circuit 106, and when the power supply voltage exceeds the predetermined voltage value, capacitor 104 stops being charged through charging bypass circuit 106.

Therefore, a variation in the power supply voltage (helix voltage Ehel) due to a variation in the load can be reduced without the need for increasing the capacitance of capacitor bank 104.

Therefore, the high-frequency circuit system is capable of reducing a variation in the power supply voltage even when a pulsed voltage is applied to the anode electrode to drive traveling-wave tube 1 in a pulsed mode.

Inasmuch as the capacitance of capacitor bank 104 for reducing a variation in the power supply voltage can be reduced, it is possible to reduce the size of power supply apparatus 100.

Figure 1:
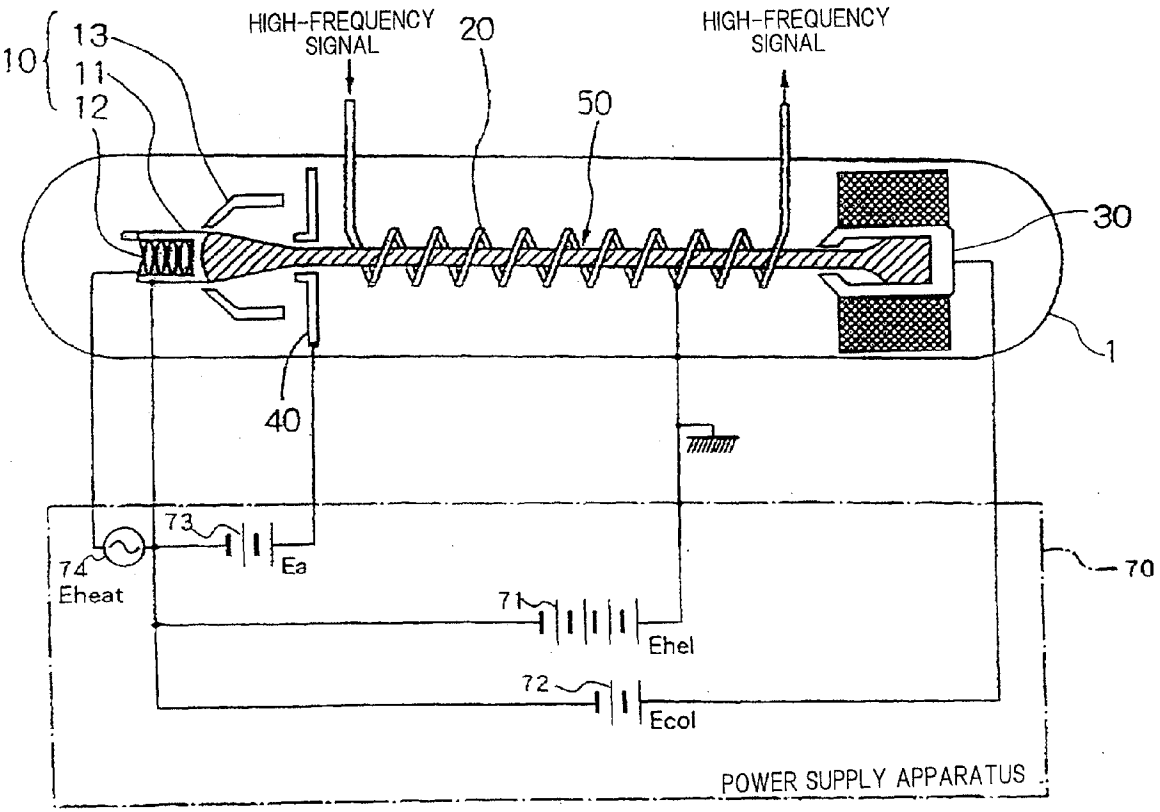
Fig. 1 RELATED ART
FIG. 1 is a view showing an arrangement of a high-frequency circuit system.
Figure 2:
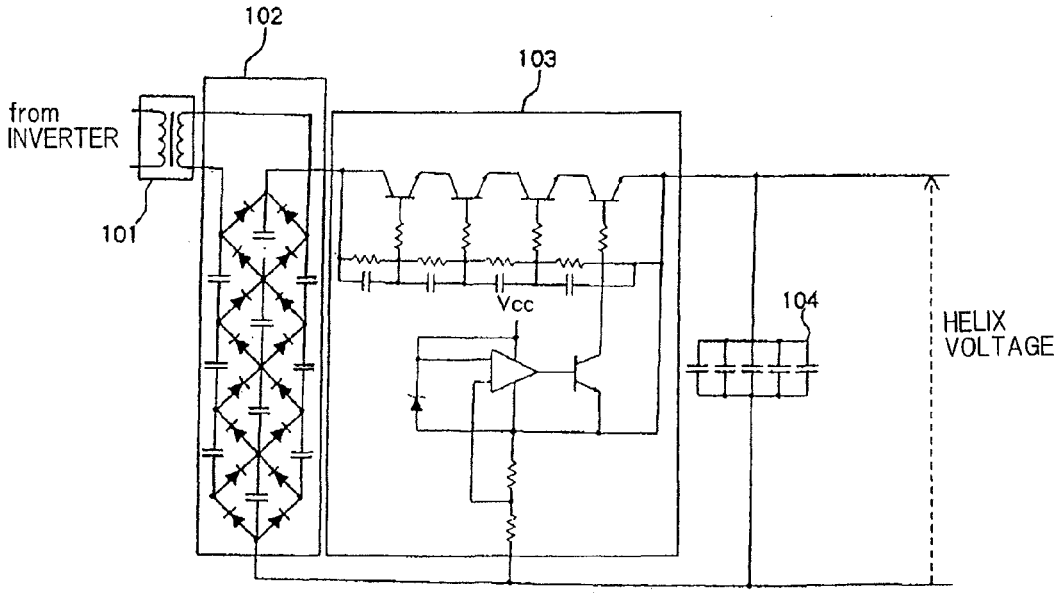
Fig. 2 RELATED ART
FIG. 2 is a circuit diagram of a conventional power supply apparatus.

In the above embodiment, the power supply apparatus and the high-frequency circuit system have been described with respect to the example wherein the power supply apparatus that supplies the power supply voltage (helix voltage Ehel) is provided between the cathode electrode and the helix of traveling-wave tube 1 shown in FIG. 1. However, the power supply apparatus according to the present invention is not limited to supplying the helix voltage Ehel to traveling-wave tube 1, but may be used to supply the power supply voltage to any circuits and apparatus insofar as they have series regulator 103 comprising a plurality of transistors and insofar as they suffer a voltage drop due to a load variation while in operation.

While preferred embodiments of the present invention have been described using specific terms, such description is for illustrative purposes only, and it is to be understood that changes and variations may be made without departing from the spirit or scope of the following claims.

What is claimed is:

1. A power supply apparatus comprising:

a rectifying circuit;

a series regulator for generating a predetermined power supply voltage from a DC voltage output from said rectifying circuit;

a capacitor bank of rectifying capacitors for stabilizing said power supply voltage;

a charging bypass circuit connected between input and output terminals of said series regulator, said charging bypass circuit being turned on or off by an externally supplied drive signal; and a charging bypass control circuit for turning on said charging bypass circuit when a drop of said power supply voltage is detected.

2. The power supply apparatus according to claim 1, wherein said charging bypass control circuit supplies a drive signal having a preset time duration to said charging bypass circuit to turn on the charging bypass circuit when a drop of said power supply voltage is detected.

3. The power supply apparatus according to claim 2, further comprising:

an overvoltage comparing circuit for detecting when said power supply voltage exceeds a predetermined voltage value;

wherein said charging bypass control circuit turns off said charging bypass circuit when said overvoltage comparing circuit detects that said power supply voltage exceeds said predetermined voltage value.

4. The power supply apparatus according to claim 1, further comprising:

an overvoltage comparing circuit for detecting when said power supply voltage exceeds a predetermined voltage value;

wherein said charging bypass control circuit turns off said charging bypass circuit when said overvoltage comparing circuit detects that said power supply voltage exceeds said predetermined voltage value.

5. The power supply apparatus according to claim 1, wherein said series regulator comprises a plurality of series-connected transistors to be supplied with the DC voltage output from said rectifying circuit and for outputting said power supply voltage.

6. The power supply apparatus according to claim 1, wherein electric charges are supplied from said rectifying circuit through said charging bypass circuit to said capacitor bank for charging said capacitor bank when said charging bypass circuit is turned on.

7. The power supply apparatus according to claim 6, wherein said charging bypass circuit supplies electric charges to said capacitor bank for thereby shortening the period of time required until said power supply voltage which has dropped due to a load variation becomes stabilized.

8. The power supply apparatus according to claim 1, wherein said power supply voltage is a helix voltage supplied between a cathode electrode and a helix of a traveling-wave tube.

9. A high-frequency circuit system comprising:

the power supply apparatus according to claim 1;

an electron tube to be supplied with the predetermined power supply voltage from said power supply apparatus;

an anode switch for supplying a pulsed voltage to an anode electrode of said electron tube; and an anode switch control circuit for driving said anode switch and supplying said charging bypass control circuit with an anode pulse input signal indicative of whether said electron tube is activated or inactivated;

wherein said charging bypass control circuit turns on said charging bypass circuit if the charging bypass control circuit detects when the pulsed voltage is applied to said anode electrode based on said anode pulse input signal.

* * * * *